US006058865A

United States Patent [19]

Thibeault

[11] Patent Number: 6,058,865

[45] Date of Patent: May 9, 2000

[54] EXTRUSION-SECTIONS FOR BOATS

[76] Inventor: Sylvio Thibeault, Erl Etude et Recherche 394, St-Joseph Est, Levis, Québec, Canada, G6V 1G7

[21] Appl. No.: 09/002,431

[22] Filed: Jan. 2, 1998

Related U.S. Application Data

[60] Provisional application No. 60/038,207, Feb. 18, 1997.

[51] Int. Cl.[7] ..... B63B 3/00

[52] U.S. Cl. ..... 114/79 W; 114/88

[58] Field of Search ..... 114/88, 79 W, 114/79 R, 356, 65 R; 52/588.1

[56] References Cited

U.S. PATENT DOCUMENTS

| | | | |
|---|---|---|---|
| D. 233,035 | 10/1974 | Donne . | |
| D. 370,983 | 6/1996 | Stansfield . | |
| 3,156,210 | 11/1964 | Lyon | 114/356 |
| 3,385,182 | 5/1968 | Harvey | 52/588.1 |
| 3,388,446 | 6/1968 | Phillips | 114/356 |
| 3,708,943 | 1/1973 | Thomas et al. . | |
| 4,733,629 | 3/1988 | Hunt et al. . | |

FOREIGN PATENT DOCUMENTS

| | | | |
|---|---|---|---|
| 615819 | 3/1961 | Canada | 114/88 |
| 1205331 | 6/1986 | Canada . | |
| 1182348 | 2/1995 | Canada . | |

*Primary Examiner*—Sherman Basinger

[57] ABSTRACT

A generally rectangular metallic extrusion (20) for boat hull (21) construction, the extrusion (20) supporting a bottom sheet member (26). The extrusion (20) comprises a number of longitudinal ribs (30) installed upwardly from the bottom sheet, a first longitudinal rib (23) having a generally rounded protruding male joint (22), and a last longitudinal rib (28) having a generally concave female joint (24) mounted to surround the male joint (22) of an adjoinning extrusion (20). The male joint (22) has a recessed neck (39), of the same thickness as the bottom sheet (26), and receives a base (35) of the female joint (24) to form a welding nest. A mounting form is first set and the extrusions laid according to a desired shape. The rotation and adjustment of the protruding male joint (22) in the adjoining concave female joint (24) permits the positioning and meshing of two extrusions (20) at a selected deflection angle, before welding.

10 Claims, 3 Drawing Sheets

EXTRUSION-SECTIONS FOR BOATS

This application claims the benefit of U.S. Provisional Appln No. 60/038,207 filed Feb. 18, 1997.

BACKGROUND

1. Field of the Invention

This invention belongs to the field of boat construction, especially of boats made of metal structures.

2. Description of Prior Art

A review of the prior art has revealed the following patents:

Des 370, 983, Stansfield, Jun. 18, 1996 shows an ornamental design for an extruded section comprising female notches.

Des 233,035, Donné, Oct. 1, 1974 is a metal element comprising two female joints.

U.S. Pat. No. 3,708,943, Thomas et al. Jan. 9, 1973 illustrates an Aluminum facing and roofing sheet system comprising S-shaped shoulders and grooves. Sheets are joined together by closure caps and anchoring clips.

U.S. Pat. No. 4,733,629, Hunt et coll., Mar. 29, 1988, shows a strip of polyethylene material with intermediate ribs 48 and waterproof joints wherein a head 42 is placed in a channel 32. This system is conceived to make tubular structures of constant diameter, such as for flotation devices. This system does not have a great capacity of adjustment.

CA 1,205,331, Eder et coll., Jun. 3, 1986, is a planking assembly. This method shows a joint made of a double-hook formation, one hook 1 and an arch 2, both acting in tension. The joint uses screws to compress a rubber core. The deflexion is adjusted by the screw and a metal wedge and then welded. The ribs are at the junction between two planks and the relative angle of 15°. There is no intermediate rib.

CA 1,182,348, Disen, Feb. 12, 1995, has a method to construct boat hulls. The extrusion has a rectangular joint. These joints are maintained together by thermo setting glue and press blocks 13. This system does not allow angular variation of the joints.

OBJECTIVES AND ADVANTAGES

One objective is to provide a multipurpose boat for transportation of persons and goods, to be used for fishing, pleasure or freight. A boat that is lighter and more secure and provides a design that lightens considerably the hull of a boat. Particularly to allow the integration of sheet metal to the structure, therby reducing the weight, welding and increasing the strength. The capacity to hold in position the different parts with a strength equal to or superior to that of a normal weld, without having its weight. A system to eliminate many of the transverse structures, to make the designing easier and allow a greater diversity of shapes.

One particular objective is to provide a joint with a ball shape rotated in a concave reception area, with a pair of spaced apart welds, the joint acting as support between the two welds.

DRAWINGS

An embodiment of the invention will be better explained by referring to the following drawings wherein like numbers refer to like parts and in which.

DESCRIPTION OF THE EMBODIMENT

In the description that follows and in the accompanied drawings similar numbers refer to identical parts in the varied figures.

Figure 1:
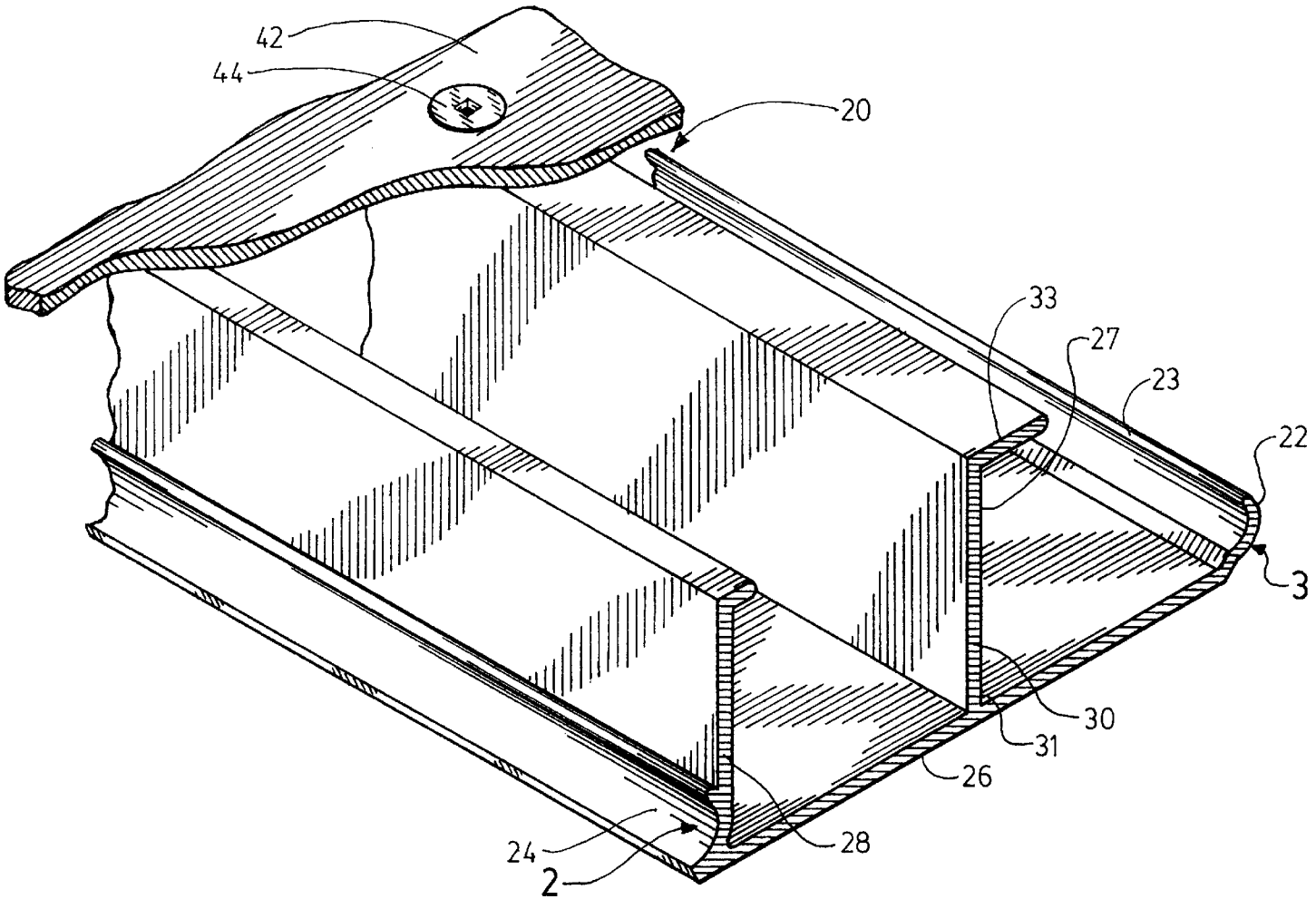
FIG. 1 is a perspective of a section of a hull of a riverboat.
Figure 4:
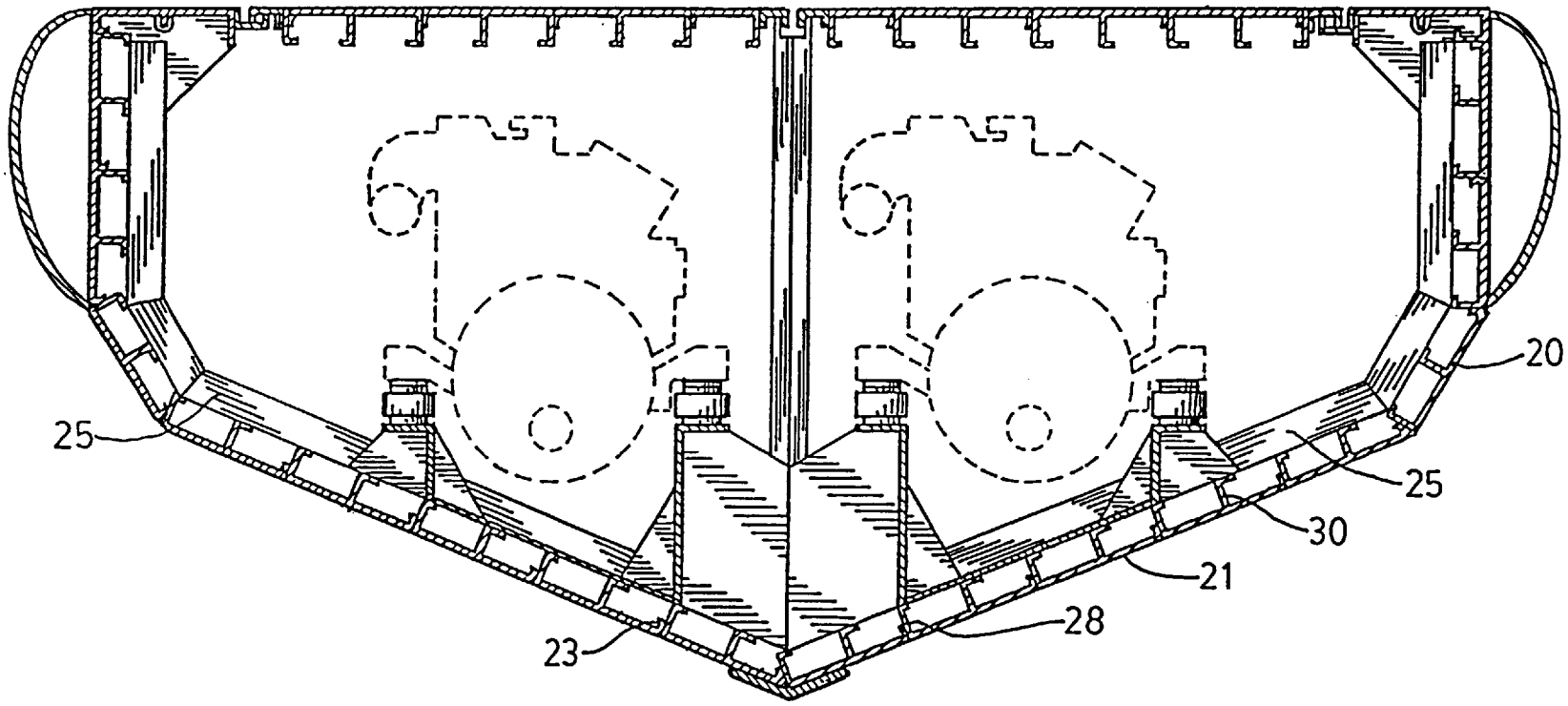
FIG. 4 is a view of an assembly of several sections of FIG. 1 to make up a hull.

FIG. 1 illustrates a metallic extrusion 20 at a deflection area of a hull 21—FIG. 4—, comprising two joints showing a male joint 22 and a female joint 24 located on both sides of a bottom sheet 26. At least one longitudinal rib 30, which is an intermediate rib 27, and a first coupling rib 23, and a last coupling rib 28 are fixed vertically on the bottom sheet 26. The upper part of the last coupling rib 28 and that of the intermediate rib 27 have an inverted L-shape defining an upper part 33. These L-shaped parts are used to hold finishing trims to the hull 21 such as floor plates 42 secured by rivets 44.

Figure 2:
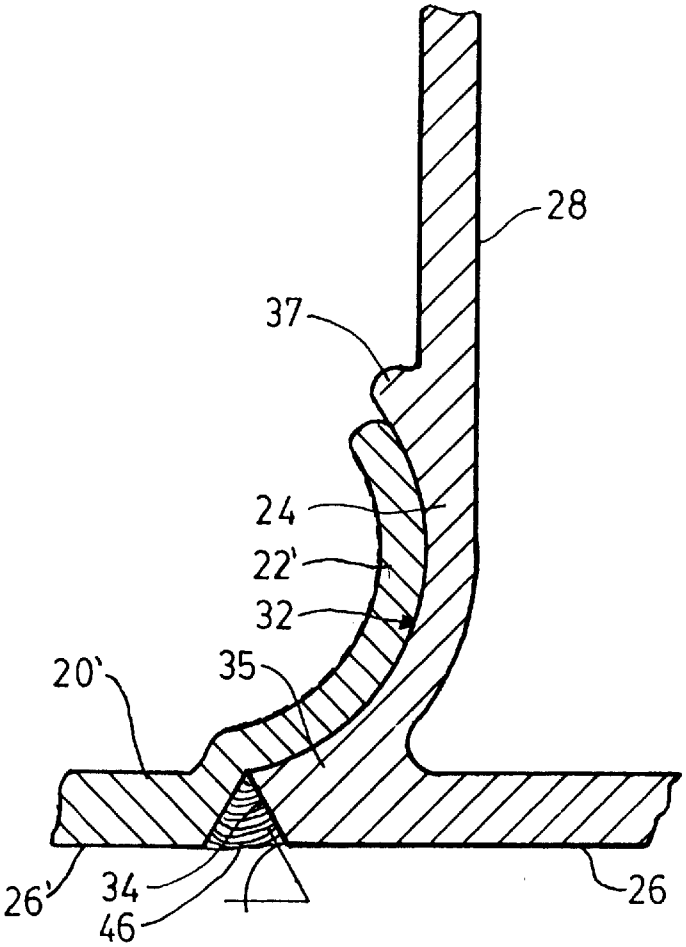
FIG. 2 is a view of a female joint according to arrow 2 of FIG. 1.

FIG. 2 shows the female joint 24 on the lower part 31 of the last coupling rib 28. It comprises a groove 32, curved inwardly, starting from a base 35 and finishing at a tip 37. There also is a right beveled edge 34 of an angle of 60 degrees at the base 35 where it joins the bottom sheet 26 to provide a welding nest 40—FIG. 3. One sees in dotted line, the male joint 22 of an adjoining extrusion 20 and which rest in continuous contact, through an arc of 120°, with of the groove 32.

Figure 3:
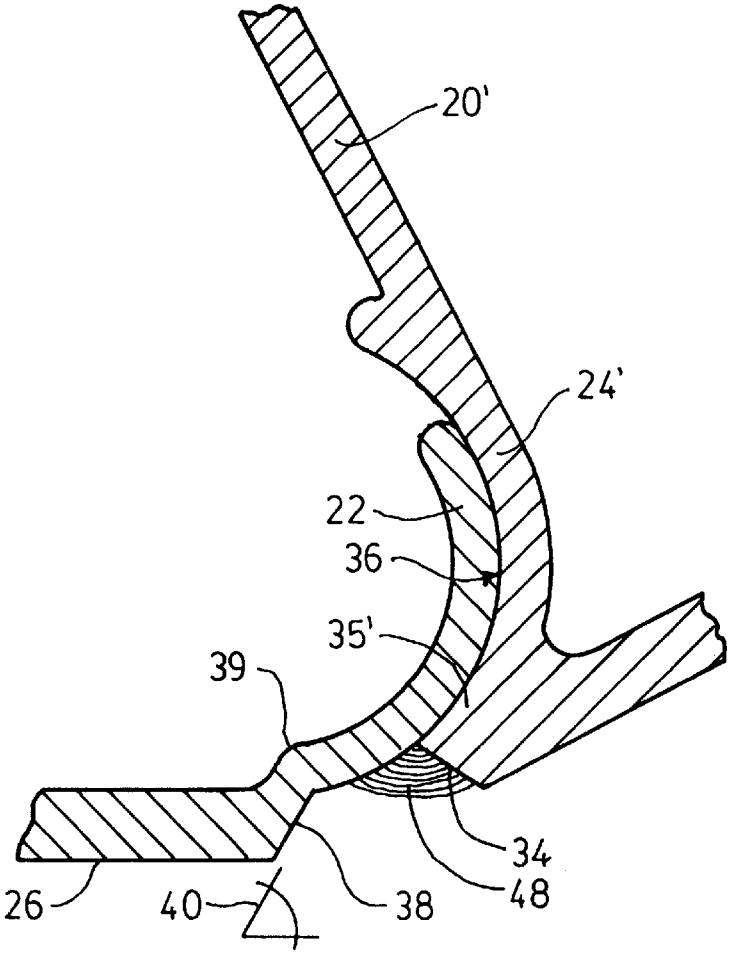
FIG. 3 is a view of a male joint according to arrow 3 of FIG. 1.

FIG. 3 illustrates the male joint 22 on the first coupling rib 23. It comprises an arch 36, curved outwardly so it will fit perfectly with the groove 32 of the female joint 24. A left beveled side 38 also at an angle of 60 degrees and opposed to the right beveled side 34, shown in dotted line. A neck 39 links the bottom sheet 26 and the arch 36 of the male joint 22.

When the neck 39 of the male joint 22 is placed against the base 35 of the female joint 24, the junction of the two beveled sides 34 and 38 provide a chamfered joint used as welding nest 40. The chamfered joint is surounded by a wall of even thickness, thus creating a well protected welding nest 40.

FIG. 4 shows a cross section of the hull 21, illustrating the assembly of a number of extrusions 20. The position of two machine rooms is apparent.

Method of construction

This method may be applied to structures of various shapes and sizes.

It comprises the following steps:

a) Construct a skeleton frame of the final dimension of the hull of the boat.

b) Identify transition lines of the skeleton frame.

c) Install a bottom sheet 26 member on the skeleton frame. The bottom sheet 26 comprises a number of longitudinal ribs 30 installed upwardly from the bottom sheet 26, a first coupling rib 28 comprises a generally concave female joint 24. The last coupling rib 23 comprises a generally rounded protruding male joint 22.

d) Assemble along the transition line, a male joint 22 with a female joint 24 of an adjacent metallic extrusion 20 to an adjusted position.

e) Slidingly engage the male joint 22 against the female joint 24 and place them a coplanar position as shown in FIG. 2 or at any selected angled position as shown in FIG. 3 at an angled position, f) Weld in place as shown at 46, 48, 50, 52 in FIGS. 2 and 3, g) In the construction of boats of which the bottom sheets are metal sheets, integrate the longitudinal ribs 30 to the bottom sheet and the addition of an L-shaped member, to allow the installation onto the frame 25 of structural sheets such as the floor plate 42.

SUMMARY OF THE INVENTION

A structural component for a hull construction, the structural component defining in combination a number of generally rectangular metallic extrusions 20 comprising:

a bottom sheet 26 member having a length and a thickness.

at least one longitudinal rib 30, which is an intermediate rib 27, upwardly installed from the bottom sheet 26, a first coupling rib 23, comprising a protruding convex male joint 22, and a last coupling rib 28 comprising a generally concave female joint 24 adapted to surround a corresponding male joint 22' of an adjoining rectangular metallic extrusion 20'. The female joint 24' is mounted to surround the male joint 22 to provide a wing to the last coupling rib 28 to form a structure similar to the intermediate rib 27. The addition of a number of corresponding rectangular metallic extrusions 20', the positioning to an adjusted position and the welding in place thereof between the female joint 24' and the male joint 22 cause a firm solid structure for a hull construction.

The intermediate rib 27 has a lower part 31 placed on the bottom sheet 26 and an upper part 33. The upper part 33 has an inverted L-shape. The coupling rib 28 also comprises a lower part 31 and an upper part 33 also having a inverted L-shape.

The female joint is located at the lower part 31 of the coupling rib 28. The female joint 24 has a base 35, a groove 32 and a tip 37. The base 35 is located at the junction between the last coupling rib 28 and the bottom sheet 26 and the tip 37 protrudes from the last coupling rib 28. The male joint 22 coincides with the first coupling rib 23 and comprises an arch 36 and a neck 39 to be placed on the base 35' of an adjoining female joint 24'. The arch 36 coincides with the groove 32' of the female joint 24'.

The groove 32 of the female joint 24 has an arc of a circle of 110° to 130°. The arch 36 of the male joint 22 has an arc of a circle corresponding to the arc of a circle of the groove 32.

The female joint 24 comprises, at its base 35, a right beveled side 34. The male joint 22 has a left beveled side 38; the combination of the beveled sides 34,38 defines a chamfered joint forming a welding nest 40 to weld together the bottom sheets 26 of the extrusions 20. The right beveled side 34 and left beveled side 38 have an angle varying between 50° and 70°.

The neck 39 provides a material contribution of 1.0 to 1.9 times the thickness of the bottom sheet 26 to compensate for the loss of strength caused by the melting of the metal, to facilitate the welding.

A method of hull construction comprises the following steps:

provide a skeleton frame of the final dimension of the hull of the boat.

identify transition lines of the skeleton frame.

install a bottom sheet 26 member on the skeleton frame. The bottom sheet 26 comprises at least one longitudinal rib 30 upwardly installed from the bottom sheet 26, a first coupling rib 28 comprising a generally concave female joint 24, a last coupling rib 23 comprising a generally rounded protruding male joint 22.

assemble, along the transition line, the male joint 22 with a female joint 24' of an adjacent metallic extrusion 20 to an adjusted position, slidingly engage the male joint 22 against the female joint 24 and move to an angled position, weld in place.

in the construction of boats of which a bottom sheet is a metal sheet, integrate the at least one longitudinal rib 30 to the bottom sheet and add an inverted L-shaped member to the longitudinal rib 30, to permit the installation of physical elements.

While the present invention has been shown in the drawings and fully described above with particularity and detail in connection with what is presently deemed to be the most practical and preferred embodiment of the invention, it will be apparent to those of ordinary skill in the art that many modifications thereof may be made without departing from the principles and concepts set forth therein. Hence, the proper scope of the present invention should be determined only by the broadest interpretation of the appended claims so as encompass all such modifications and equivalents.

Other embodiments of the above invention are also possible and limited only by the scope of the following claims:

Parts

20 Metallic extrusion
22 Male joint
23 First coupling rib
24 Female joint
25 Frame
26 Bottom sheet
27 Intermediate rib
28 Last coupling rib
30 Longitudinal rib
31 Lower part
32 Groove
33 Upper part
34 Right beveled side
35 Base
36 Arch
37 Tip
38 Left beveled side
39 Neck
40 Welding nest
42 Floor plate
44 Floor rivet

I claim:

1. A structural component for a hull construction, said structural component defining in combination:

a number of generally rectangular metallic extrusions (20) comprising:

a bottom sheet (26) member having a length and a thickness at least one longitudinal rib (30) which is an intermediate rib (27) upwardly installed from said bottom sheet (26), a first coupling rib (23) comprising a protruding convex male joint (22) and a last coupling rib (28) comprising a generally concave female joint (24) adapted to surround a corresponding convex male joint (22') of an adjoining rectangular metallic extrusion (20'), said intermediate rib comprising at least one web and one wing, said female joint (24') mounted to surround said male joint (22) to provide a wing to said last coupling rib (28) to form a structure similar to said intermediate rib (27), the addition of a number of corresponding rectangular metallic extrusions (20'), the positioning to an adjusted position and the welding in place thereof between said female joint (24') and said male joint (22) causing a firm solid structure for a hull construction.

2. The component of claim 1 wherein said intermediate rib (27) has a lower part (31) placed on said bottom sheet (26) and an upper part (33), said upper part (33) having an inverted L-shape, said last coupling rib (28) also comprising a lower part (31) and an upper part (33) also having an inverted L-shape.

3. The component of claim 2 wherein said female joint is located at said lower part (31) of said last coupling rib (28), said female joint (24) having a base (35), a groove (32) and a tip (37), said base (35) being located at a junction between said last coupling rib (28) and said bottom sheet (26) and said tip (37) protruding from said last coupling rib (28).

4. The component of claim 3 wherein said male joint (22) coincides with said first coupling rib (23) and comprises an arch (36) and a neck (39) to be placed on said base (35') of an adjoining female joint (24'), said arch (36) coinciding with said groove (32') of said female joint (24').

5. The component of claim 4 wherein said groove (32) of said female joint (24) has an arc of a circle of 110° to 130°, said arch (36) of said male joint (22) having an arc of a circle corresponding to said arc of a circle of said groove (32).

6. The component of claim 4 wherein said female joint (24) comprises, at said base, a right beveled side (34), said male joint (22) having a left beveled side (38), the combination of said beveled sides (34,38) defining a chamfered joint forming a welding nest (40) to weld together said bottom sheets (26) of said extrusions (20).

7. The component of claim 6 wherein said right beveled side (34) and left beveled side (38) have an angle varying between 50° and 70°.

8. The component of claim 7 wherein said neck (39) provides a material contribution of more than the thickness of said bottom sheet (26) to compensate for the loss of strength caused by the melting of the metal, to facilitate the welding.

9. A method of hull construction comprising the following steps:

provide a skeleton frame of the final dimension of said hull of said boat, identify transition lines of said skeleton frame, install a bottom sheet (26) member on said skeleton frame, said bottom sheet (26) comprising at least one longitudinal rib (30) upwardly installed from said bottom sheet (26), a first coupling rib (28) comprising a generally concave female joint (24), and a last coupling rib (23) comprising a generally rounded protruding male joint (22), assemble along said transition line, said male joint (22) with a female joint (24') of an adjacent metallic extrusion (20) to an adjusted position, slidingly engage said male joint (22) against said female joint (24) and move to an angled position, weld in place.

10. The method of claim 9 comprising an additional step:

in the construction of boats of which a bottom sheet is a metal sheet, the integration of said at least one longitudinal rib (30) to said bottom sheet, said longitudinal rib having a reversed L-shape to permit the installation of physical elements.

* * * * *